United States Patent [19]

Gargione

[11] 3,945,060

[45] Mar. 23, 1976

[54] LIQUID DISPENSING BOTTLE-HANGER CONSTRUCTION

[75] Inventor: Frank V. Gargione, Egg Harbor, N.J.

[73] Assignee: The Climalene Company, Canton, Ohio

[22] Filed: Oct. 3, 1974

[21] Appl. No.: 511,780

[52] U.S. Cl. ..... 4/228; 222/181; 248/312

[51] Int. Cl.[2] ..... E03D 9/03

[58] Field of Search ..... 4/228, 227; 222/181; 248/312, 311, 313

[56] References Cited

UNITED STATES PATENTS

| | | | |
|---|---|---|---|
| 1,222,486 | 4/1917 | Swanson | 248/312 |
| 2,245,703 | 6/1941 | Mueller | 222/181 X |
| 3,118,645 | 1/1964 | Lewis et al | 248/312 |
| 3,192,894 | 7/1965 | Stauer | 248/359 X |
| 3,389,883 | 6/1968 | Johnson | 248/311 X |
| 3,627,177 | 12/1971 | Marcus | 222/181 |

*Primary Examiner*—Richard E. Aegerter
*Assistant Examiner*—Michael H. Thaler
*Attorney, Agent, or Firm*—Frease & Bishop

[57] ABSTRACT

A liquid dispensing bottle has a mounting clip for hanging the bottle in an inverted position within a flush tank of a toilet for automatically dispensing a predetermined amount of liquid during each flushing operation. A circular boss is formed on the bottom wall of the bottle and the clip is rotatably mounted thereon for movement between stored and hanging positions. The clip has a pair of arcuate fingers which circumferentially, slidably engage the boss, and an L-shaped member a portion of which extends upwardly along a protuberance formed in a lower portion of the bottle side wall when in a stored position. The L-shaped member forms a channel or hook with the side wall of the bottle when the clip is rotated 90° from stored to hanging position and the top edge of the flash tank is engaged by the L-shaped member to hang the bottle thereon. A plurality of ribs are formed on the clip bottom surface to provide a flat, horizontal, three point support for displaying and storing the bottle in a stable upright position.

13 Claims, 8 Drawing Figures

LIQUID DISPENSING BOTTLE-HANGER CONSTRUCTION

BACKGROUND OF THE INVENTION

1. Field of the Invention

The invention relates to liquid-dispensing bottle constructions, and in particular to bottle constructions for mounting a dispensing bottle in an inverted position within the tank of a toilet for automatically dispensing a regulated amount of liquid upon each flushing operation. More particularly, the invention relates to such a dispensing bottle having a clip rotatably mounted on the bottom wall of the bottle which forms a hook with a side wall of the bottle for hanging the bottle within the tank, and for providing a level support for displaying and storing the bottle in a stable upright position.

2. Description of the Prior Art

Numerous types and styles of liquid-dispensing bottles and mounting clips therefor have been devised for placement within the flush tank of a toilet for automatically dispensing liquid therein. Examples are shown in U.S. Pat. Nos. 2,798,230, 3,627,177, 3,698,021, 3,118,645, 2,980,277, and 2,722,394.

Many of these constructions require metal mounting clips or brackets which are subject to rust and discoloration or require special attachments for mounting on the liquid-containing bottle. Furthermore, many of these metal clips do not conform to the general appearance and shape of the bottle and are unattractive to a prospective purchaser when stored for display on the shelf.

The most serious problem with prior combination bottle-clip constructions is the bulkiness and nonconformity of the clip with the bottle configuration, making it extremely difficult to ship and display a plurality of such bottles. Likewise, many of these constructions require special manipulation of the clip by the user, occasionally resulting in breaking of the clip or improper mounting when installing the bottle within a flush tank.

No toilet tank liquid-dispensing bottle-clip construction of which I am aware has eliminated such problems by providing a rotatably-mounted clip formed of plastic material on the bottom of the bottle which conforms generally to the outline of the bottle, preventing unsightly and inconvenient projections extending therefrom, which assists in providing a plurality of planar surfaces for supporting the bottle in a stable upright position during storage and display and which presents a pleasing, attractive appearance to prospective purchasers.

SUMMARY OF THE INVENTION

Objectives of the invention include providing a toilet tank liquid-dispensing bottle-clip construction for automatically dispensing a predetermined amount of liquid into a flush tank upon each flushing operation, and which has an improved hanging clip rotatably mounted on the bottom wall of the bottle; providing such a bottle-clip construction in which the hanging or the mounting clip conforms to the general shape and configuration of the bottle to provide a pleasing and attractive appearance when placed on a display shelf in a supermarket or the like, and in which the clip provides a horizontal bottom surface for supporting such bottles in a stable upright position for shipment, storage and display; providing a mounting clip for such a bottle construction which may be produced rapidly and economically of plastic, which can be dyed during molding to match the color of the dispensing bottle to provide the attractive appearance desired, and which has sufficient strength and flexibility to provide the support for the bottle when mounted in inverted position within a flush tank; providing a mounting clip construction which is produced separately from the bottle construction thereby reducing the cost of both the bottle and clip; in which the clip has sufficient flexibility due to the nature of the plastic material from which it is formed to be easily snap-fit on a boss formed on the bottom wall of the bottle, and in which the clip can be rotated easily from its stored position to its mounting position when installing the bottle within a flush tank; providing a generally oval or elliptical cylindrical shaped bottle construction preferably formed of nonbreakable plastic with an inwardly tapered bottom side wall portion, in which the bottle is provided with a protuberance in the tapered side wall bottom portion, and in which the clip aligns with the side wall protuberance when the clip is in stored position; and providing a bottle construction which eliminates difficulties heretofore encountered, achieves the stated objectives simply and effectively, and solves problems and satisfies needs existing in the art.

These objectives and advantages are obtained by the toilet tank liquid-dispensing bottle-clip construction, the general nature of which may be stated as including a bottle having at least side and bottom walls; L-shaped clip means rotatably mounted on the bottom wall for movement between stored and hanging positions; the clip means having leg means extending along and closely adjacent to the bottle side wall when in stored position; the leg means being displaced from the bottle side wall when the clip means is rotated at least 90° from stored position to hanging position, whereby the bottle can be suspended in an inverted position from an article which is engaged in the area between the leg means and bottle side wall; the bottle having a generally oval or elliptical cylindrical shape with the clip means extending along the major axis when in stored position and extending along the minor axis when in hanging position; the lower portion of the bottle bottom wall being tapered inwardly and formed with a protuberance which extends outwardly from one side wall, the protuberance being located radially inwardly of a vertical plane which is parallel to the longitudinal axis of the bottle and tangent to the outermost part of the bottle side wall; the clip means having a pair of generally semicircular finger means forming a circular opening therebetween; boss means formed on the bottle bottom wall and engageable with the finger means for rotatably mounting the clip means on the boss means; and rib means formed on the clip means having surfaces lying in a horizontal plane when the bottle is in an upright position to support the bottle in said upright position.

BRIEF DESCRIPTION OF THE DRAWING

A preferred embodiment of the invention — illustrative of the best mode in which applicant has contemplated applying the principles — is set forth in the following description and shown in the drawing and is particularly and distinctly pointed out and set forth in the appended claims.

Similar numerals refer to similar parts throughout the drawing.

DESCRIPTION OF THE PREFERRED EMBODIMENT

Figure 1:
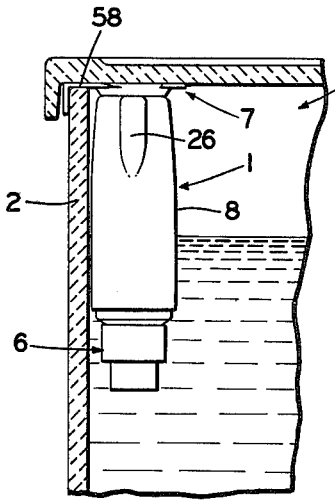
FIG. 1 is a fragmentary diagrammatic view, with portions in section, showing the liquid-dispensing bottle-clip construction hanging in inverted operating position within a toilet tank.

The improved liquid-dispensing bottle-clip construction is indicated generally at 1 (FIG. 2), and is shown in FIG. 1 being mounted on side wall 2 of a toilet flush tank 3 in inverted operating position. Construction 1 includes as the main components thereof, a bottle 4, a lid 5, a liquid-dispensing valve 6, and a mounting clip 7.

Bottle 4 preferably is molded of plastic type material and is formed by side wall 8, bottom wall 9 and top wall 10, and provides a container for storing a quantity of disinfectant to be discharged. The terms "top" and "bottom" when used throughout the following description to describe the relative position of various components of construction 1, are used in reference to bottle 4 in the upright position of FIG. 2.

Figure 2:
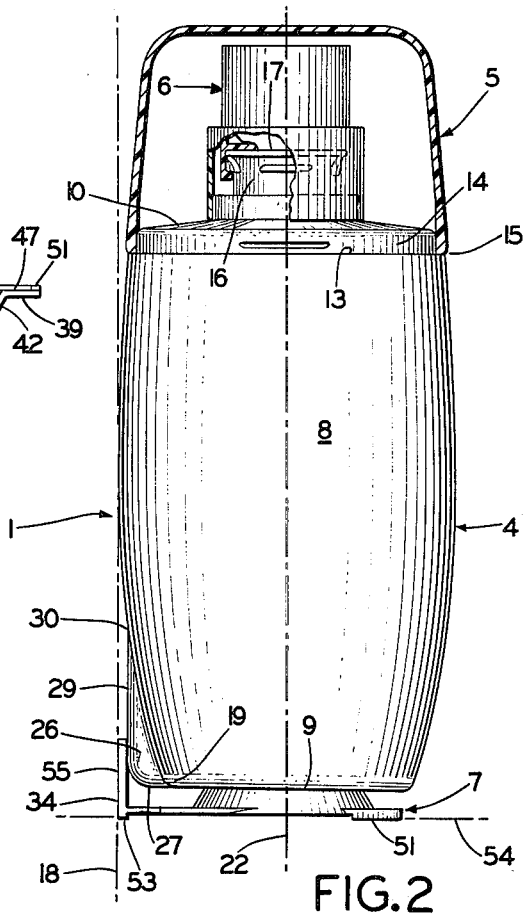
FIG. 2 is an elevational view, with portions broken away and in section, of the bottle-clip construction in storage position.
Figure 3:
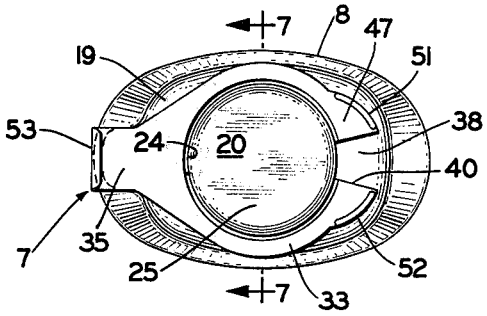
FIG. 3 is a bottom plan view of the bottle-clip construction shown in FIG. 2.

Bottle 4 has a generally elliptical or oval cylindrical configuration with the lower portion of side wall 8 being tapered inwardly towards bottom wall 9 (FIGS. 2 and 3). The upper portion of side wall 8 also may have a slight inward taper if desired. The major and minor axes indicated at 11 and 12 of the middle bottle portion (FIG. 5) thus are greater than corresponding axes taken adjacent the bottom portion of wall 8, and are greater than the corresponding axes of bottom wall 9.

Top wall 10 is connected to side wall 8 by a shoulder 13 and an upstanding annular flange wall 14. The bottom edge 15 of lid 5 seats upon shoulder 13 and frictionally engages flange wall 14 when mounted on bottle 4.

A neck 16 extends upwardly from top wall 10 and surrounds a liquid-dispensing opening 17. Liquid-dispensing valve 6 is mounted on neck 16 and regulates the amount of liquid dispensed during each flushing operation. Valve 6 forms no part of the present invention and may be one of numerous known and existing valve construction, such as shown in U.S. Pat. No. 3,766,570.

Figure 5:
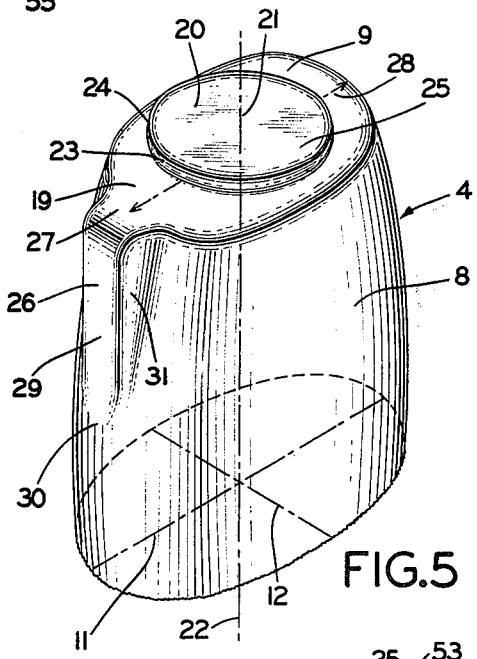
FIG. 5 is a perspective view of the bottle bottom wall and a portion of the side wall with the mounting clip removed.
Figure 6:
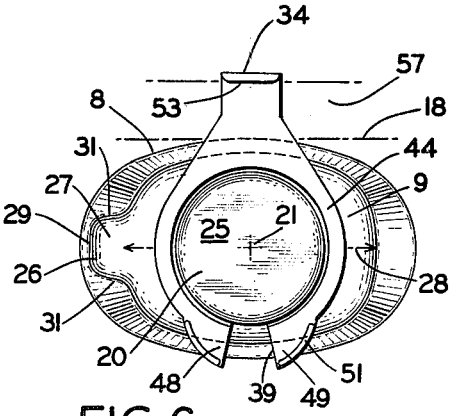
FIG. 6 is a bottom plane view of the bottle-clip construction similar to FIG. 3, with the mounting clip rotated 90° in hanging position.

In accordance with the invention, a boss 20 is formed on bottom wall 9 and projects outwardly therefrom. Boss 20 preferably has a circular configuration as shown in FIGS. 3, 5 and 6, with its center, indicated at 21, being located on the longitudinal axis 22 of bottle 4. Boss 20 is formed with a circumferentially extending groove 23 which provide a circumferential, outwardly projecting flange 24 at the top portion (when bottle 4 is in inverted position) of boss 20. Top surface 25 of boss 20 is flat and provides a horizontal planar surface when bottle 4 is in its upright, usual stored position as shown in FIG. 2.

Bottom wall 9 likewise is flat, elliptically-shaped and extends generally parallel with surface 25 of boss 20. Wall 9 terminates at one of its minor radii curved ends 19 in an outwardly-extending protuberance 26. Protuberance 26 includes a horizontal planar surface 27 which coincides with bottom wall 9 and which extends outwardly therefrom along major axis 28 of wall 9. A vertically-extending planar surface 29 extends from horizontal surface 27 and merges with side wall 8 at junction 30. Protuberance 26 further includes side wall surfaces 31 which extend between horizontal and vertical surfaces 27 and 29, and bottle side wall 8, as shown in FIGS. 5 and 6.

Vertical planar surface 29 of protuberance 26 is located inwardly from but parallel to an imaginary vertical plane 18 (FIG. 2). Plane 18 is tangential to the outer most portion of bottle side wall 8, at one end of major axis 11, the purpose of which is discussed below.

In further accordance with the invention, improved mounting clip 7 (FIGS. 4 and 8) is rotatably mounted on boss 20 for movement between its storage position of FIG. 2, and its operating or hanging position of FIGS. 1 and 6.

Clip 7 has a generally L-shaped configuration formed by fingers 32 and 33 and a hanger leg 34. Leg 34 is integrally joined at one end of fingers 32 and 33 by connecting base 35. Fingers 32 and 33 have curved generally semicircular configurations and form a circular opening 37 therebetween except for a slot 38 formed diametrically opposite base 35 by the spaced apart finger ends 39 and 40. Slot 38 and opening 37 form a generally keyholeshaped cutout between fingers 32 and 33 as shown in FIGS. 3, 4 and 6.

Figure 8:
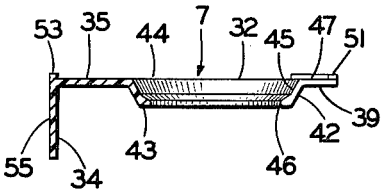
FIG. 8 is a sectional view taken on line 8—8, FIG. 4.
Figure 4:
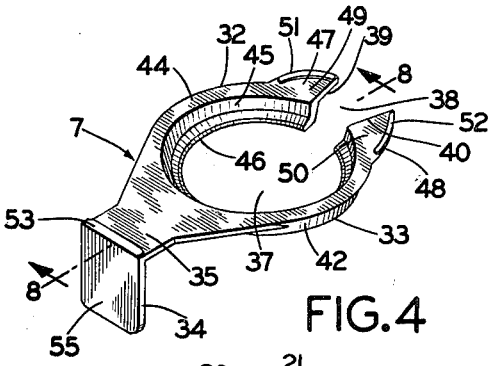
FIG. 4 is a perspective view of the mounting clip removed from the bottle.
Figure 7:
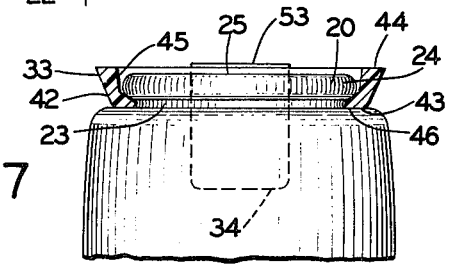
FIG. 7 is an enlarged sectional view taken on line 7—7, FIG. 3.

Fingers 32 and 33 have inwardly tapered outer side wall surfaces 42, and flat top and bottom wall surfaces 43 and 44 respectively, (FIGS. 4, 7 and 8). Bottom surfaces 44 are integral with and lie in the same horizontal plane as base 35. Inner side wall surfaces 45 of fingers 32 and 33 are tapered inwardly and terminate in an inwardly extending arcuate lip 46. Lip 46 defines the boundry of clip opening 37 and is an inwardly extension of top finger walls 43.

Spaced finger ends 39 and 40 have outwardly extending flanges 47 and 48, the bottom surfaces 49 and 50 of which lie in the same horizontal plane as bottom surfaces 44 and base 35. Flanges 47 and 48 provide increased area to the bottom of clip 7 for increasing the stability of bottle 4 when supported in an upright position by clip 7. Flanges 47 and 48 also conform to the general elliptical curved shape of bottom wall 9 for aesthetic purposes.

A pair of raised, curved ribs 51 and 52 are formed along the outer edges of flanges 47 and 48 and extend outwardly from flange surfaces 49 and 50 when clip 7 is mounted on boss 20. A corresponding rib 53 is formed on clip base 35 at the connected end of leg 34 and extends outwardly from base 35 in the same direction as flange ribs 51 and 52. The top surfaces of ribs 51, 52 and 53 lie in the same horizontal plane, indicated at 54 (FIG. 2) when clip 7 is mounted on boss 20.

Ribs 51–53 provide a level, three point support for supporting bottle 4 in a stable upright position when displayed on a merchant's shelf, during shipment, and when stored prior to use. Ribs 51–53 likewise, provides such a level support irrespective of minor depressions or other irregularities formed in the bottom of clip 7 and boss 20 during molding which could effect the stability of bottle 4 if supported directly thereon without ribs 51–53.

Clip 7 preferably is formed of plastic or similar synthetic material which imparts sufficient flexibility to finger 32 and 33, enabling the fingers to be spread sufficiently apart to mount clip 7 on boss 20.

Lip 46 has a radius of curvature approximately equal to that of boss groove 23, whereby boss flange 24 engages lip 46 (FIG. 7) to retain clip 7 on boss 20. Clip 7, thus can freely rotate about boss 20, yet is prevented from premature removal therefrom by flange 24. Top surfaces 43 of finger 32 and 33 provide a smooth flat area for supporting bottle 4 and for sliding engagement with bottom wall 9 when clip 7 is rotated on boss 20. Lip 46 has a thickness generally equal to the width of boss groove 23 so as to conform therewith as shown in FIG. 7.

Hanger leg 34 is located radially from the center point of clip opening 37 a distance equal to the radial distance from the center of boss 20 to vertical planar surface 29 of protuberance 26, so that when clip 7 is in storage position (FIGS. 2 and 3) leg 34 extends upwardly along surface 29. Leg 34 preferably contacts surface 29 when in stored position but is free to rotate in both directions past surface 29. Furthermore, the outer surface 55 of leg 34 coincides with or lies radially inwardly from vertical plane 18 as shown in FIG. 2, so as not to extend outwardly beyond the outermost extremity of side wall 8.

Construction 1, thus provides a streamline, compact, and attractive display unit, as shown in FIG. 2, when lid 5 is attached. Clip ribs 51–53 further provide three support surfaces which lie in horizontal plane 54 for supporting bottle 4 in a stable upright position. Also, clip leg 34 is within the maximum diameter of bottle wall 8 when in stored position, eliminating unsightly projections, and permitting easy packaging, shipping and displaying of a plurality of bottle-clip constructions 1.

Bottle-clip construction 1 is installed easily within flush tank 3. Lid 5 is removed and any necessary manipulation is performed on valve 6 which may be required to place it in dispensing condition. Clip 7 is rotated 90° to the hanging position of FIG. 6 whereupon leg 34 forms a channel or hook 57 with side wall 8 of bottle 4 which is hooked over top edge 58 of tank wall 2 (FIG. 1) to suspend bottle 4 in inverted position within the flush tank 3.

Thus, no additional clip or hanger brackets separate from the liquid dispensing bottle are required, nor does a housewife have to bend or shape wire hangers or perform other time consuming manipulations to install bottle 4 in operating position.

Furthermore, slightly bulged side wall 8 contacts tank wall 2 to maintain bottle 4 in a nearly vertical position and to space valve 6 from wall 2. This increases the efficiency of valve 6 and provides for complete use and discharge of the disinfectant liquid contained in bottle 4.

Sidewall 8 need not be formed with protuberance 26 nor does boss 20 have to be centrally located with respect to bottom wall 9 for the improved bottle-clip construction 1 to provide the desired advantages. The bottom portion of side wall 8 could have less taper than illustrated with the side wall curving smoothly into the areas adjacent vertical surface 29 eliminating protuberance side wall surface 31. Likewise, clip 7 could be eccentrically mounted with respect to a circular shaped bottom wall 9 so that upon rotation from stored position clip leg 34 is displaced outwardly from side wall 8 to form a channel or hook 57 therebetween.

Accordingly, bottle-clip construction 1 provides a toilet bowl liquid dispensing construction 1 which can be formed of unbreakable plastic in a variety of attractive colors, including the hanging clip in order not to distract from the appearance of the bottle; provides a construction which permits a plurality of such dispensing units to be packed, shipped and displayed conveniently and economically since the hanging clip does not project beyond the bulged sides of the bottle; provides a construction in which the hanging clip can be molded of plastic separate from the bottle and then rapidly and conveniently mounted thereon without additional attachment or faster means, and in which the housewife need only rotate the clip 90° from its stored position on the bottle for forming a hook-like configuration with the bottle side wall for hanging the bottle in an inverted position within a flush tank; and provide structures and arrangements which are very simplified, which eliminates difficulties existing in the art, and which achieve the stated objectives and solves problems that have existed in the art.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries, and principles of the invention, the manner in which the improved toilet bowl liquid dispensing bottle-clip construction is constructed, assembled and operated, the characteristics of the new construction, and the advantageous, new and useful results obtained; the new and useful structures, devices, elements, arrangements, parts, and combinations are set forth in the appended claims.

I claim:

1. Combination bottle-hanging clip construction for hanging a bottle in inverted position including a bottle having at least side and bottom walls, said side wall being generally elliptically cylindrically shaped with a longitudinal axis, and having major and minor axes in transverse cross section; the lower portion of the bottle side wall is tapered inwardly and is jointed integrally with the bottle bottom wall; and the bottom wall is elliptically shaped having major and monor axes corresponding with and smaller than the respective major and minor axes of the bottle side wall; said bottom having boss means formed thereon; clip means having L-shaped leg means, said clip means having means engaging said boss means and being rotatably mounted on said bass means on the bottom wall for movement between stored and hanging positions; one leg of the clip means extending along the major axis of the bottom wall closely adjacent to the bottle bottom wall when in stored position, and the other leg of said clip means is positioned radially inwardly of a vertical plane which is parallel to the longitudinal axis of the bottle and tangent to the outermost portion of the bottle side wall when the clip means is in said stored position; and the clip means being rotated 90° from stored position to hanging position, wherein said one leg of said clip means extends along the minor axis of the bottom wall, and said other leg extends generally parallel to said longitudinal axis and is spaced laterally from the side wall whereby the combined legs form a channel with the side wall for hanging the bottle in an inverted position.

2. The construction defined in claim 1 in which a protuberance is formed in the tapered side wall portion adjacent the bottom wall and aligns with the side wall major axes; and in which the leg means engages said protuberance when the clip means is in stored position.

3. The construction defined in claim 2 in which the bottom wall lies in a horizontal plane when in an upright position; in which the protuberance includes a horizontal planar surface lying in the plane of the bottom wall, and a vertical planar surface extending upwardly from said horizontal surface and merging with the side wall; and in which the leg means engages said vertical planar surface when the clip means is in stored position.

4. The construction defined in claim 1 in which the clip means has a pair of generally semicircular fingers extending from the L-shaped leg means and form a generally circular opening therebetween; and in which said fingers extend circumferentially about the boss means which is located within said opening to rotatably mount the clip means on said boss.

5. The construction defined in claim 4 in which a plurality of rib means are formed on the clip means; and in which said rib means have outer flat surfaces, said surfaces lying in a horizontal plane when the bottle is in an upright position for supporting the bottle in said upright position.

6. The construction defined in claim 4 in which the fingers have first and second ends; in which said first ends are integrally connected to the L-shaped leg means; in which the second ends are spaced apart and form a slot therebetween which communicates with the circular opening; and in which said fingers have sufficient flexibility permitting said second ends to be moved apart increasing the size of said slot, whereby the clip means can be mounted on the boss means.

7. The construction defined in claim 4 in which the longitudinal axis of the bottle passes through the center of the bottom wall circular boss.

8. A clip-container construction including a clip having a pair of generally semicircular finger means forming a generally circular opening therebetween; the finger means having first and second ends; L-shaped leg means having a base and a leg member, said base being integrally connected with the finger means first ends; the finger means second ends being spaced apart and forming a slot therebetween, said slot communicating with the circular opening; a container having at least side and bottom walls, with the side wall being generally elliptically cylindrically shaped and having a circular boss formed on said bottom wall; the clip finger means being circumferentially engaged with the boss rotatably mounting the clip thereon for movement of the clip between stored and hanging positions; the leg means leg member extending along and closely adjacent a lower portion of the container side wall and being radially inwardly of the container side wall's maximum diameter when in stored position, and the leg member being spaced from the container side wall when in hanging position so that an article upon which the container is to be mounted may be engaged therebetween.

9. The construction defined in claim 8 in which the container and clip are formed of plastic.

10. The construction defined in claim 8 in which ribs are formed on the finger means second ends and on the leg means base; in which said ribs have flat outer surfaces which lie in a common plane; and in which said ribs provide bottom support means for supporting the container in an upright position.

11. The construction defined in claim 8 in which the boss has an outwardly extending circumferential flange; in which the finger means are found with lip means which defines the clip circular opening; and in which said lip means engages the boss flange for rotatably mounting the clip on the boss.

12. The construction defined in claim 8 in which the finger means have tapered side walls terminating in flat end surfaces; and in which said end surfaces slidably engage the container bottom wall.

13. The construction defined in claim 8 in which the bottom portion of the container side wall is tapered inwardly; in which a protuberance is formed in said tapered bottom portion; and in which the leg means leg member engages said protuberance when in stored position.

* * * * *